US011498802B2

(12) United States Patent
Marvin et al.

(10) Patent No.: US 11,498,802 B2
(45) Date of Patent: Nov. 15, 2022

(54) ELEVATOR SYSTEMS AND METHODS OF CONTROLLING ELEVATORS RESPONSIVE TO DETECTED PASSENGER STATES

(71) Applicant: Otis Elevator Company, Farmington, CT (US)

(72) Inventors: Daryl J. Marvin, Farmington, CT (US); Stella M. Oggianu, West Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 882 days.

(21) Appl. No.: 16/342,614

(22) PCT Filed: Oct. 17, 2017

(86) PCT No.: PCT/US2017/056900

§ 371 (c)(1),
(2) Date: Apr. 17, 2019

(87) PCT Pub. No.: WO2018/075463

PCT Pub. Date: Apr. 26, 2018

(65) Prior Publication Data

US 2019/0241398 A1 Aug. 8, 2019

Related U.S. Application Data

(60) Provisional application No. 62/409,025, filed on Oct. 17, 2016.

(51) Int. Cl.

| | |
|---|---|
| ***B66B 5/00*** | (2006.01) |
| ***B66B 1/28*** | (2006.01) |
| ***B66B 1/34*** | (2006.01) |

(52) U.S. Cl.

CPC ..... *B66B 1/28* (2013.01); *B66B 1/3407* (2013.01); *B66B 5/0012* (2013.01); *B66B 5/0018* (2013.01)

(58) Field of Classification Search

CPC ... B66B 5/0012; B66B 5/0018; B66B 5/0006; B66B 5/0037; B66B 1/3446; B66B 1/00; B66B 11/0233; B66B 5/00

See application file for complete search history.

(56) References Cited

U.S. PATENT DOCUMENTS

| | | | |
|---|---|---|---|
| 10,017,355 | B2 | 7/2018 | Silvennoinen et al. |
| 2017/0362054 | A1 | 12/2017 | Legeret et al. |

FOREIGN PATENT DOCUMENTS

| | | | |
|---|---|---|---|
| CN | 104692210 | A * | 6/2015 |
| CN | 105967019 | A * | 9/2016 |

(Continued)

OTHER PUBLICATIONS

International Search Report, International Application No. PCT/US2017/056900, dated Mar. 19, 2018, International Search Report 4 pages.

(Continued)

*Primary Examiner* — Marlon T Fletcher
(74) *Attorney, Agent, or Firm* — Cantor Colburn LLP

(57) ABSTRACT

Elevator systems and methods of use including an elevator car located within an elevator shaft, at least one sensing device arranged within the elevator car, an elevator controller arranged to control at least one of an operating condition and at least one feature within the elevator car, and a computing system in communication with the at least one sensing device and the elevator controller, wherein the computing system is arranged to detect a passenger state of a passenger within the elevator car and configured to control the operating conditions and features within the elevator car based on the detected passenger state.

20 Claims, 6 Drawing Sheets

(56) References Cited

FOREIGN PATENT DOCUMENTS

| | | | | | |
|---|---|---|---|---|---|
| CN | 106744115 | A | * | 5/2017 | |
| CN | 107010504 | A | * | 8/2017 | |
| CN | 107074484 | A | * | 8/2017 | ..... B66B 1/2408 |
| DE | 202017007194 | U1 | * | 2/2020 | ..... B66B 5/0006 |
| EP | 1584597 | A1 | | 10/2005 | |
| EP | 3075697 | A1 | * | 10/2016 | ..... B66B 1/3461 |
| EP | 3309107 | A1 | * | 4/2018 | ..... B66B 13/26 |
| EP | 3312124 | A1 | * | 4/2018 | ..... B66B 19/007 |
| EP | 3470354 | A1 | * | 4/2019 | ..... B66B 5/0006 |
| EP | 3315443 | B1 | * | 3/2021 | ..... B66B 1/46 |
| GB | 2272786 | A | | 5/1994 | |
| JP | 2005255404 | A | | 9/2005 | |
| KR | 20160125763 | A | * | 11/2016 | |
| WO | WO-2016085795 | A1 | * | 6/2016 | ..... B66B 1/28 |
| WO | WO-2018075463 | A1 | * | 4/2018 | ..... B66B 1/28 |

OTHER PUBLICATIONS

International Written Opinion, International Application No. PCT/US2017/056900, dated Mar. 19, 2018, International Written Opinion 6 pages.

* cited by examiner

ELEVATOR SYSTEMS AND METHODS OF CONTROLLING ELEVATORS RESPONSIVE TO DETECTED PASSENGER STATES

CROSS REFERENCE TO RELATED APPLICATIONS

This is a U.S. National Stage of Application No. PCT/US2017/056900, filed on Oct. 17, 2017, which claims the benefit of U.S. Provisional Patent Application No. 62/409,025, filed on Oct. 17, 2016, the disclosures of which are incorporated herein by reference.

The present application claims priority from U.S. Provisional Patent Application No. 62/409,025, filed Oct. 17, 2016. The contents of the priority application are hereby incorporated by reference in its entirety.

BACKGROUND

The subject matter disclosed herein generally relates to elevator systems and, more particularly, to elevator systems configured to respond to detected passenger states.

BRIEF SUMMARY

Various embodiments include elevator systems as shown and described herein.

Various embodiments include, elevator systems configured to operate and/or change operating conditions and/or features within an elevator car based on a detected passenger state.

In addition to one or more of the features described herein, or as an alternative, further embodiments of the elevator systems may include at least one element to monitor, detect, and/or determine a detected passenger state, wherein the detection is either one of direct detection and indirect detection.

In addition to one or more of the features described herein, or as an alternative, further embodiments of the elevator systems may include that direct detection includes at least one of video analytics, heartbeat detection, breathing detection, and detection of level of sweating.

In addition to one or more of the features described herein, or as an alternative, further embodiments of the elevator systems may include that the operating conditions includes at least one of an elevator car acceleration, an elevator car deceleration, and an elevator travel speed.

In addition to one or more of the features described herein, or as an alternative, further embodiments of the elevator systems may include that features of the elevator car that can be adjusted based on a detected passenger state include, at least, lighting, music, spoken words, and content displayed on a display screen within the elevator car.

In addition to one or more of the features described herein, or as an alternative, further embodiments of the elevator systems may include that the detected passenger state is at least one of an emotional state and a health/physical state of the detected passenger.

In addition to one or more of the features described herein, or as an alternative, further embodiments of the elevator systems may include that, when multiple passengers are present within the elevator car, the system is configured to determine at least one of an average detected passenger state or a highest priority detected passenger state and operate and/or change operating conditions based on the average or highest priority, respectively.

Various other embodiments include methods of controlling an elevator car as shown and described herein.

Various other embodiments include methods of controlling an elevator car that include obtaining detected passenger state data related to a passenger and adjusting at least one elevator car operating mode or at least one feature within an elevator car based on the detected passenger state.

In addition to one or more of the features described herein, or as an alternative, further embodiments of the methods may include detecting a detected passenger state with at least one device within the elevator car.

In addition to one or more of the features described herein, or as an alternative, further embodiments of the methods may include that the detected passenger state is at least one of an emotional state and a health/physical state of the detected passenger.

In addition to one or more of the features described herein, or as an alternative, further embodiments of the methods may include, when multiple passengers are present within the elevator car, determining at least one of an average detected passenger state or a highest priority detected passenger state and operating and/or changing operating conditions based on the average or highest priority, respectively.

Technical effects of embodiments of the present disclosure include elevator systems configured to operate and/or adjust functionality in response to a detected passenger state. That is, technical effects include element systems that receive data related to a particular user detected passenger state and perform one or more actions and/or responses based on the user detected passenger state.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
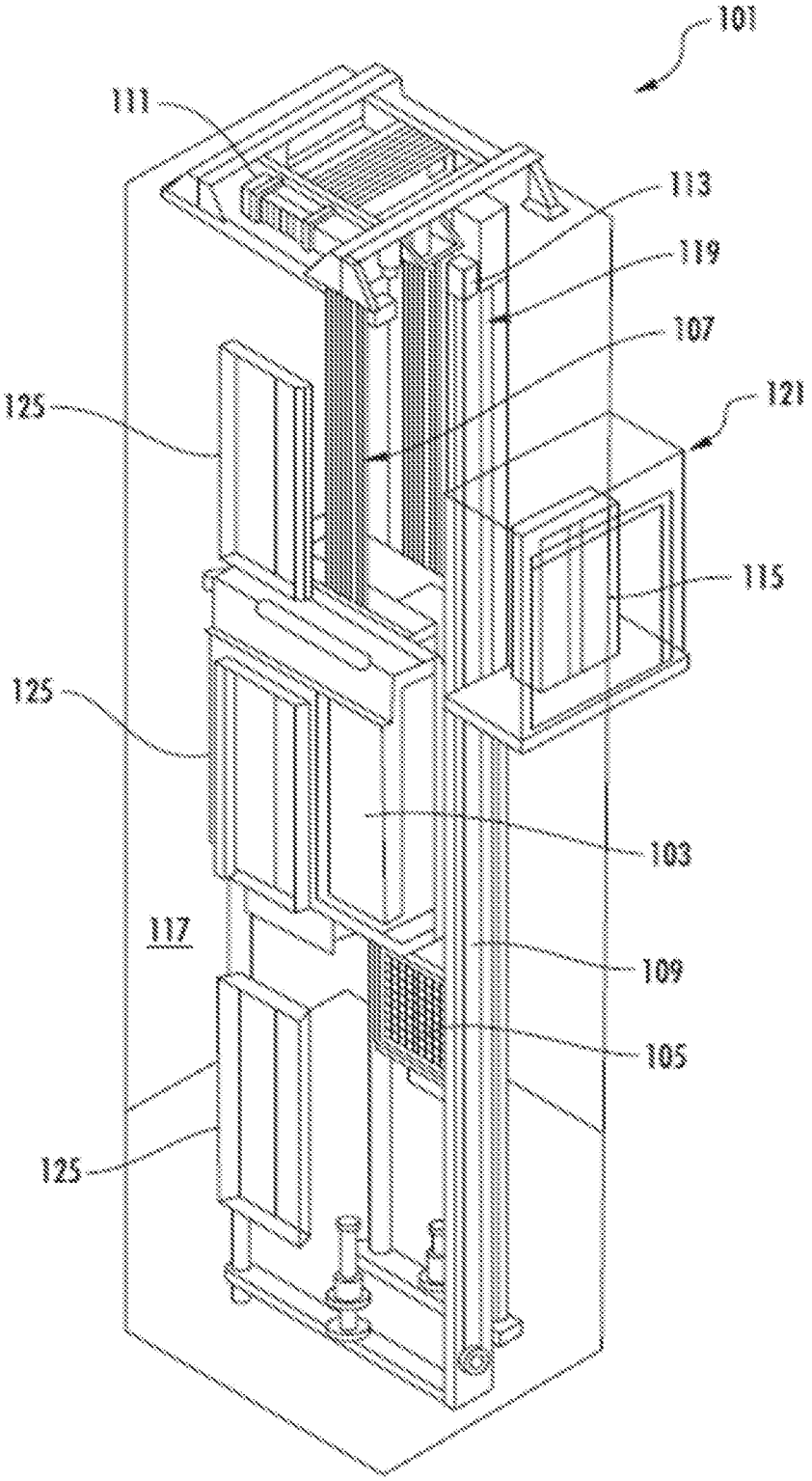
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101. In some embodiments, the elevator controller 115 can be configured to control features within the elevator car 103, including, but not limited to, lighting, display screens, music, spoken audio words, etc.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Embodiments provided herein are directed to apparatuses, systems, and methods related to elevator detection and response and actions tied to or based on detected passenger states. That is, an elevator system can take one or more actions based on user data related to a user which may be based on the passenger's emotional and/or health state. For example, an elevator system can be configured to adjust lighting, sounds, music, or features within an elevator car and/or can adjust an operation mode of the elevator car based on data indicating a detected passenger state. Accordingly, elevator systems provided herein incorporate sensing, video, and/or computing systems that either directly or indirectly acquires user data related to a detected passenger state of the user. Detected passenger states can include health and/or emotional states that include, but are not limited to, intentions, moods or emotions and can also include physical health states. For example, health states can include wheelchair-bound persons, people with walkers or canes, expecting mothers, adult versus child versus toddler versus infant (e.g., age of passengers), etc. Intentions of a passenger can include the intention to leave the elevator, damage the elevator, etc. Thus, elevator systems of the present disclosure can include computing systems to generate instructions to take certain actions or responses, store certain operating mode information, store user profiles, enable control or communication, etc.

Figure 2:
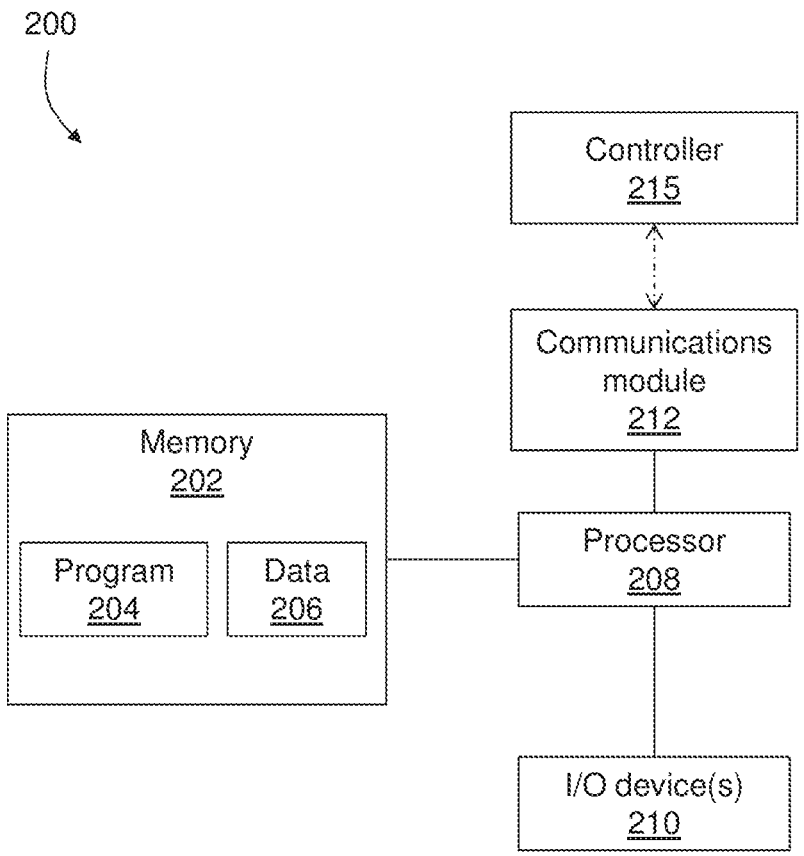
FIG. 2 is a schematic block diagram illustrating a computing system that may be configured one or more embodiments of the present disclosure.

For example, referring now to FIG. 2, an exemplary computing system 200 that can be incorporated into elevator systems of the present disclosure is shown. The computing system 200 may be configured as part of and/or in communication with an elevator controller 215, e.g., similar to controller 115 shown in FIG. 1, through a communications module 212. The system includes a memory 202 which may store executable instructions and/or data. The executable instructions may be stored or organized in any manner and at any level of abstraction, such as in connection with one or more applications, processes, routines, procedures, methods, etc. In some embodiments, the computing system may incorporate computing algorithms that are arranged to enable transmission of all collected sensing or video data to an elevator control system. In other embodiments, predetermined or relevant meta-data can be transmitted to the elevator control system, with such embodiments requiring less bandwidth, digital memory, and/or power. As an example, at least a portion of the instructions are shown in FIG. 2 as being associated with a program 204.

Further, as noted, the memory 202 may store data 206. The data 206 may include profile or registration data, elevator car data, a device identifier, or any other type(s) of data as will be appreciated by those of skill in the art. The instructions stored in the memory 202 may be executed by one or more processors, such as a processor 208. The processor 208 may be operative on the data 206.

The processor 208 may be coupled to one or more input/output (I/O) devices 210. In some embodiments, the I/O device(s) 210 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, video, etc. The I/O device(s) 210 may be configured to provide an interface to allow a user to interact with the computing system 200. For example, the I/O device(s) may support a graphical user interface (GUI) and/or voice-to-text capabilities.

The components of the computing system 200 may be operably and/or communicably connected by one or more buses. The computing system 200 may further include other features or components as known in the art. For example, the computing system 200 may include one or more transceivers and/or devices configured to transmit and/or receive information or data from sources external to the computing system 200. For example, in some embodiments, the computing system 200 may be configured to receive information over a network (wired or wireless). The information received over the network may be stored in the memory 202 (e.g. as data 206) and/or may be processed and/or employed by one or more programs or applications (e.g., program 204). As shown, the computing system 200 includes a communications module 212 that can include various communications components for transmitting and/or receiving information and/or data.

The computing system 200 may be used to execute or perform embodiments and/or processes described herein. For example, the computing system 200, when configured as part of an elevator control system, may be used to receive commands and/or instructions, and may further be configured to control operation of and/or features of an elevator car.

The computing system and/or elevator system of the present disclosure can be part of an intelligent integrated system of the building in which the elevator is located. Such intelligent integrated systems can be configured to interact with and/or communicate with user devices (e.g., cell phones, smart phones, RFID tags, etc.) that may include user identification data and/or user profile data. The intelligent integrated system can be configured or programmed to perform specific actions based on data contained within the user profile data and/or associated with the user identification data. Further, as provided herein, whether user data is obtained, elevator systems can be configured to respond to or take action in response to a detected passenger state (i.e., a health and/or emotional state of someone riding the elevator). In some embodiments, the actions taken by the elevator system can be predefined or preferred by a user as defined within a user profile. However, if a user profile does not exist, embodiments provided herein can be configured to take action based on a detected passenger state of a passenger of the elevator, e.g., as detected and determined by the elevator system.

Various mechanisms or methods of detecting a user's or passenger's emotional and/or health state (and combinations thereof) may be employed in embodiments of the present disclosure. For example, in some embodiments, a detected passenger state may be pre-determined from an external or remote device, with detected passenger state data (e.g., user data) transmitted from the remote device to the elevator system. For example, a passenger's smartphone or wearable technology can monitor a user's emotional and/or health state (e.g., heart rate, body temperature, breathing, sweating, gait, etc.). When the user/passenger walks into a building or near an elevator system having embodiments described herein, detected passenger state information and/or user data can be sent from the user device to the elevator system (e.g., automatically, upon request from the elevator system, or pushed from the user device). In other configurations (or in combination therewith), elevator systems of the present disclosure can be configured to detect a passenger's health or emotional state. For example, optical sensors, video cameras, microphones, thermal sensors, radar technologies, etc. can be used to detect the presence of passengers near or within an elevator car and can measure various characteristics to determine a detected passenger state of a passenger. Accordingly, some embodiments provided herein are configured to obtain detected passenger state data either directly or indirectly.

Figure 3:
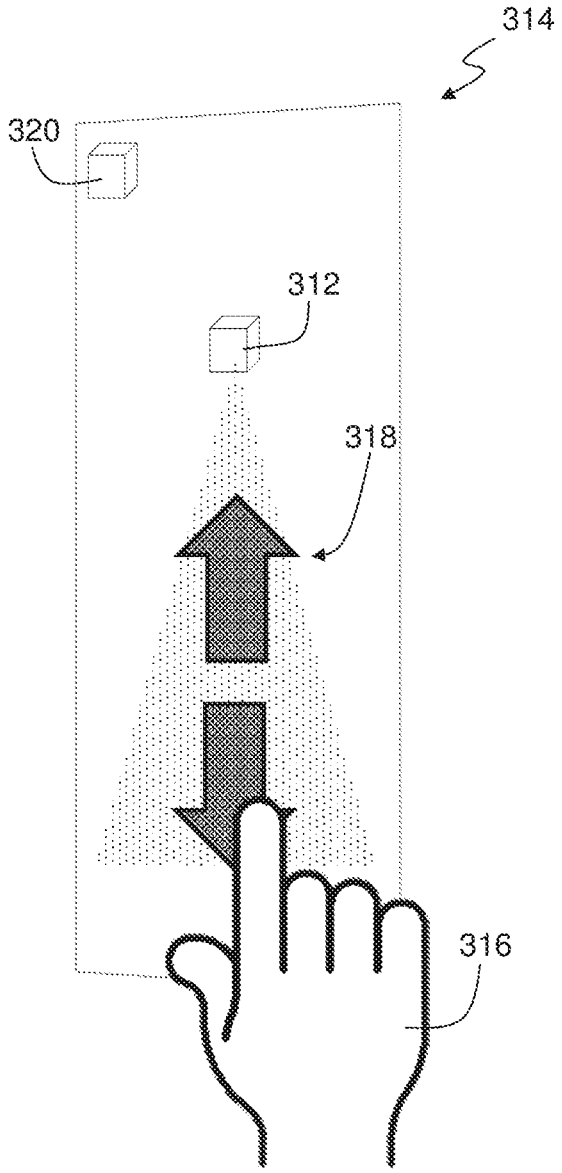
FIG. 3 is a schematic illustration of an elevator hall call panel in accordance with an embodiment of the present disclosure.

For example, turning to FIG. 3, a schematic illustration of one mechanism for an elevator system to obtain detected passenger state data in a direct manner is shown. In FIG. 3, an optical sensor 312 is positioned on or near an elevator hall call panel 314. The optical sensor 312 can detect and measure characteristics of a passenger's hand 316 when the hand 316 is in proximity to the hall call panel 314. Other types of sensors can be used without departing from the scope of the present disclosure. Further, in some embodiments, the hall call panel 314 can include hall call buttons 318 that can include various sensors embedded therein. Thus, when a passenger interacts with the hall call buttons 318, the sensors embedded therein can detect or measure characteristics from the passenger's hand 316 (e.g., heart rate, body temp, etc.). The sensors of the embodiment shown in FIG. 3 can be in a passive state when no passenger is nearby, and an optional proximity sensor 320 can be configured to activate the one or more sensors of the hall call panel 314 when a passenger is detected within a predetermined distance or proximity of the hall call panel 314.

Figure 4:
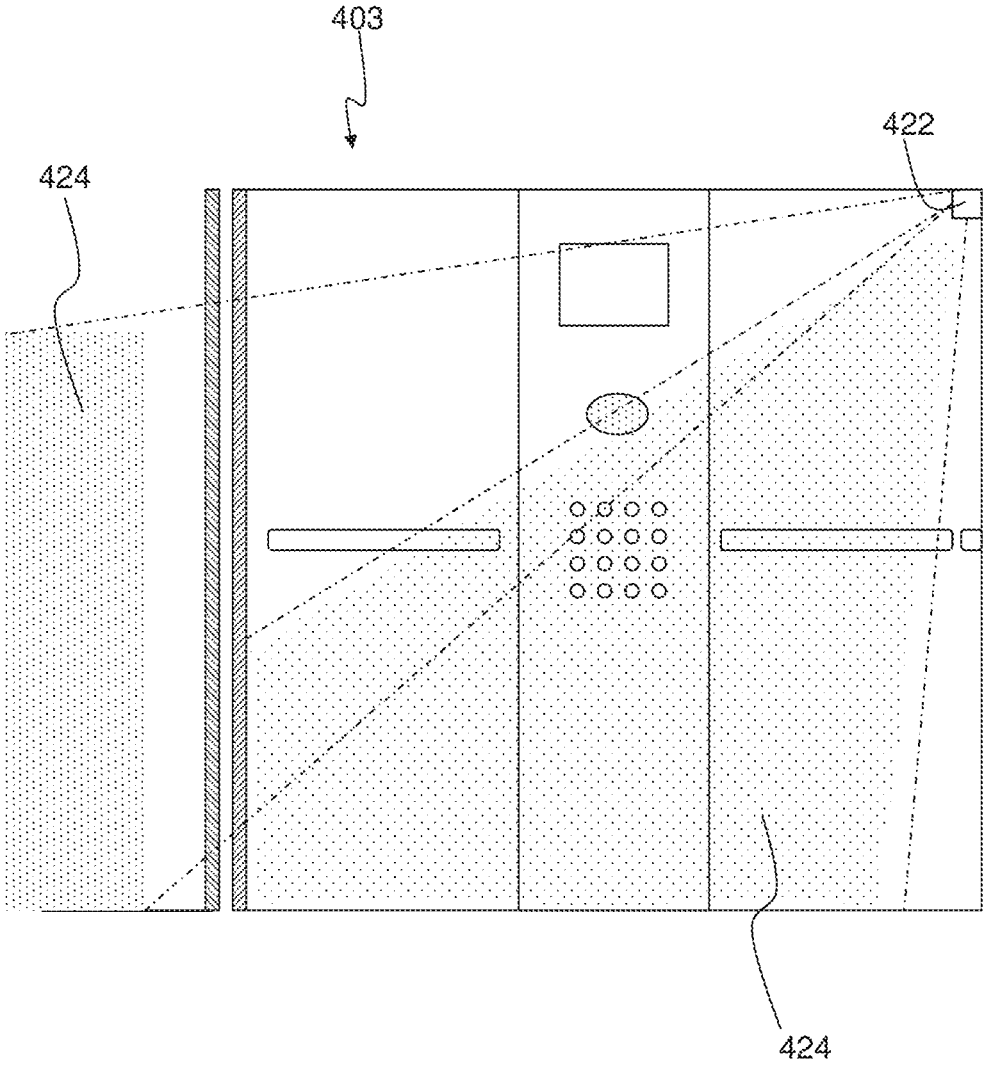
FIG. 4 is a schematic illustration of an elevator car configured in accordance with an embodiment of the present disclosure.

Turning now to FIG. 4, another schematic illustration of a mechanism for an elevator system to obtain detected passenger state data directly is shown. In FIG. 4, an elevator car 403 includes a sensor 422 positioned and installed within the elevator car 403 and configured to detect passengers entering the elevator car 403 and/or within the elevator car 403. The sensor 403 can be a camera, optical sensor, or other type of sensor that detects passengers in detection zones 424, as shown (e.g., outside and/or inside the elevator car 403). A camera can be used to obtain images or video that can be analyzed for content and/or characteristics of detected passengers. For example, analytics on top of video or radar can be performed by a processor of the system to detect various physical characteristics of a detected passenger. Such analysis can be performed to determine, for example, if a passenger is in a wheelchair, using a cane, walker, or crutches to aid in mobility, if the passenger is a child, toddler, or infant, if the passenger is elderly, etc. Such detected passenger state data can be used in embodiments of the present disclosure to determine an operating state of an elevator car and/or functions and features within the elevator car.

Figure 5:
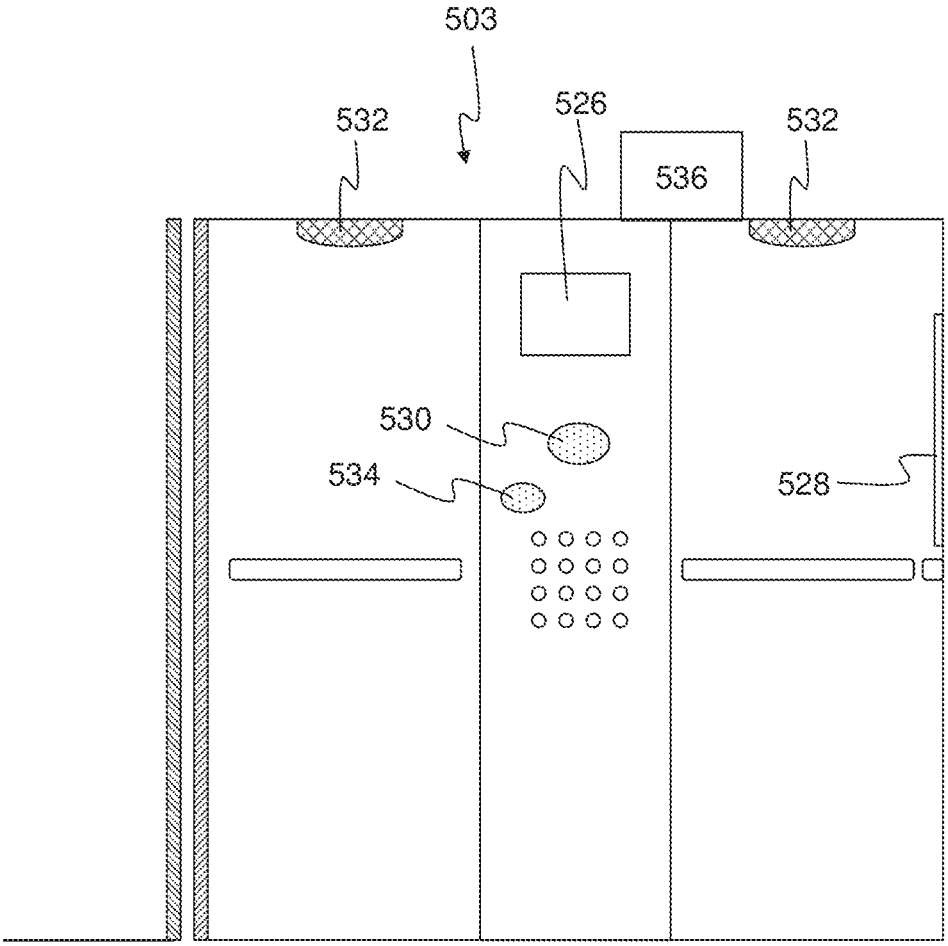
FIG. 5 is a schematic illustration of an elevator car illustrating features of the elevator car that can be controlled in accordance with embodiments of the present disclosure.

Turning now to FIG. 5, a schematic illustration of an elevator car 503 configured with various features that can be controlled by elevator systems of the present disclosure is shown. As illustrated, the elevator car 503 includes a first display 526, a second display 528, a speaker 530, a microphone 534, temperature controls and/or an HVAC system 536, and one or more lights 532. In some configurations, the first display 526 is an information display indicating elevator direction of movement and/or current floor. Further, the second display may be a television or other display screen that can be used to display commercials, building information, weather, news, and/or other types of images and/or information thereon (e.g., information specific to the user based on detected user data). The speaker 530 can be configured to generate audio such as spoken words or music. For example, the speaker 530 can be used to communicate information to passengers within the elevator car 503. The speaker 530, as noted, can be used to play music and/or ambient sounds within the elevator car 503. The lights 532 can be LEDs or other types of lights and in some embodiments can be configured to change color, brightness, tone, warmth/temperature, etc. Further, although shown with the lights 532 located at the ceiling of the elevator car 503, those of skill in the art will appreciate that additional or other lights can be located at various other locations within the elevator car 503 (e.g., accent lighting about wall panels and/or at the base of wall panels).

Each of the above described devices and features and other devices and features within elevator cars can be operably connected to an elevator controller (e.g., as described above). The elevator controller can be configured to control one or more characteristics and/or parameters related to the particular device. For example, the elevator controller can be configured to control a color, a tone, a brightness level, and an on/off state of the lights 532, or to control the amount, direction, and temperature of air flows. Further, the elevator controller can be configured to control the music and audio characteristics thereof, control the displays for content etc., or may be have control over other various features and/or devices. Additionally, the elevator controller can be configured to control a voice that is used to communicate with passengers within the elevator car (e.g., automated announcements), and can control characteristics or parameters such as tone, cadence, volume, gender, etc. Moreover, as noted above, the elevator controller can be used to control operation of the elevator car, including, but not limited to, operating speed and rates of acceleration and deceleration.

The elevator controller is configured to obtain detected passenger state data/information (either directly or indirectly) and take action based on the detected passenger state data/information. That is, embodiments provided herein are directed to an elevator system that responds to a detected passenger state of a passenger. As noted above, the detected passenger state data/information can be obtained through various mechanisms, including, but not limited to, facial expression, video and image analytics, wearable technology data, heart rate sensors, optical or other types of sensors (e.g., heart rate detection, breathing, sweat, volume or audio levels, voice, body temperature, etc.) and/or communication transmitted from a user device (e.g., data or a profile of the passenger).

The elevator system is configured to take action based on a mood or emotional state and/or a health state of the passenger. For example, if the detected passenger state data indicates that a passenger is in a hurry, the elevator controller can adjust the acceleration and speed of travel of the elevator car within the building to enable a passenger to reach a desired destination faster. However, in contrast, if the detected passenger state data indicates that a passenger is stressed out or nervous, the elevator controller can take one or more actions to ease the passenger's comfort. For example, the lighting, music, and spoken words within the elevator car and be changed soothing tones, volumes, colors, etc. Further, the elevator controller can change the operating condition of the elevator such that motion (e.g., acceleration) of the elevator car can be nearly undetectable to the passenger (e.g., in the case of a passenger that is nervous or scared of elevators). Further, if the detected passenger state data indicates that the passenger is in a potentially sensitive physical health state, adjustment may be made appropriately, such as easing a passenger's comfort of travel by reducing acceleration for a passenger that is on crutches or in a wheelchair.

Further, based on the obtained detected passenger state of the passenger, the elevator controller can take further actions. For example, if the elevator system detects a panic attack or other extreme detected passenger state, the system can react accordingly. For example, in some configurations, if a panic attack is detected, the system can try to sooth the passenger, as described above, and can further call authorities and/or medical personnel to provide immediate assistance to the passenger. Similar actions can be taken for a passenger that has a heart attack on the elevator car during operation. For example, the detection of a heartbeat that stops can detect a passenger is in peril. During such event, embodiments of the present disclosure can contact emergency help and can also provide instructions within the elevator car to assist and calm other passengers that may be present.

Figure 6:
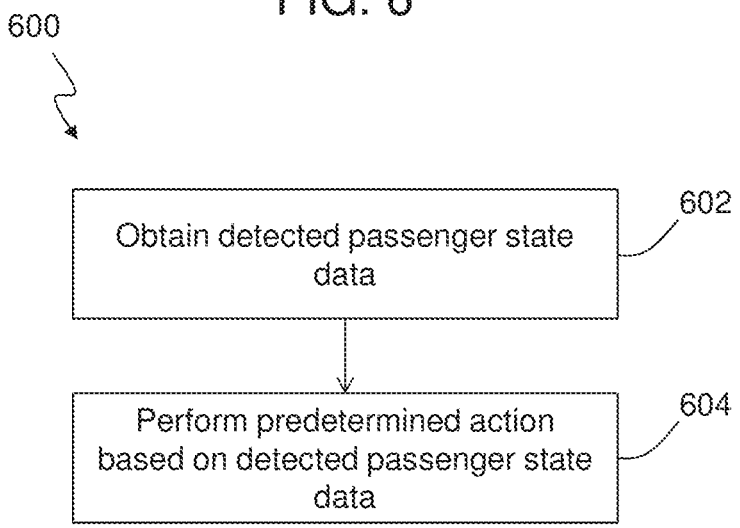
FIG. 6 is a flow process for controlling an elevator car in accordance with an embodiment of the present disclosure.

Turning now to FIG. 6, a flow process 600 in accordance with an embodiment of the present disclosure is shown. The flow process 600 can be performed using an elevator system and/or elevator controller as described above. At block 602, a detected passenger state of a passenger is obtained. The detected passenger state can be directly or indirectly measured and obtained, as described above. Upon receiving the detected passenger state data, the system can perform one or more predetermined actions that are based on the detected passenger state data, as shown at block 604.

As noted, the actions performed by the elevator system/controller can be predetermined. For example, various human states are known to be responsive positively given certain external stimuli and/or environmental conditions. Accordingly, elevator systems in accordance with embodiments provided herein can be configured to cater a response to generate conditions that are conducive and responsive to a passenger's detected passenger state. In the event of passengers that are detected to be in a hurry, a predetermined response can include increased elevator acceleration, increased elevator speed, tone and/or music to provide an atmosphere of traveling faster to a destination, etc. In contrast, when a passenger is distraught, soothing lighting, music, voice tones, etc. can be provided to calm or otherwise sooth the passenger's emotional state.

When detecting a passenger's emotional and/or health state, systems provided herein can incorporate various factors and/or means for determining a detected passenger state. For example, a high heart rate can indicate an urgency to get to a destination or it can indicate someone is anxious. Thus, multiple parameters or data can be used to determine a particular detected passenger state of a passenger. In such cases, audio and/or visual data may provide additional data points to indicate a detected passenger state of a passenger.

In some configurations, a passenger can indicate their emotional, health, and/or comfort state directly. For example, in some configurations, the elevator car can be configured with an input device (e.g., touch panel, etc.) that enables a user to indicate a mood or state of mind. Such direct input can be cleared after a specific amount of time or after the passenger is detected leaving the elevator car. Those of skill in the art will appreciate that in any of the above embodiments and/or variations thereon (or combinations thereof), a timer or other criteria can be used to end a particular emotional response operation (e.g., when a passenger is detected as exiting the elevator car).

Further, in some embodiments, elevator systems in accordance with the present disclosure can have a decision tree or algorithm to take a particular action when multiple passengers are detected in an elevator car. For example, each detected passenger state (e.g., emotional and/or physical/health based) can be assigned a priority value. When multiple passengers are detected, the elevator system can take action based on a highest priority of all of the detected passengers. For example, distraught or physically impaired states may be assigned higher priority than persons that merely have an urgency state detected. In such situations, the elevator system is configured to take action based on the highest priority which can be the most sensitive state detected. In other configurations, the elevator system can be configured to take an average of all detected states, and then take appropriate responsive action based on the averaged detected state. Similar processes can be used when the detected passengers have preset user profiles and preferred elevator modes operations and/or when a mix of preset user profiles and detected passengers (i.e., with no preset user profile) are present within an elevator car. Those of skill in the art will appreciate that the systems/processors of the present disclosure can include algorithms that can detect an average passenger state or maximize 'likes'/preferences, or detect the preferences or state of the most important passenger (e.g., a VIP or preferred customer), or a passenger who is in more need (as predefined based on a ranking or priority system).

What follows is an example of a person/passenger that interacts with a non-limiting embodiment in accordance with the present disclosure. The person/passenger will be referred to as "Jane." Jane has a presentation that she starts to get nervous about at a building that includes an elevator system in accordance with the present disclosure. Jane's heart is pounding due to the anticipated stress because this is a big day in her career. As she walks up to the building, the building's intelligent integrated system picks up a signal from Jane's personal device(s) (e.g., smartphone, wearable device, etc.) and identifies Jane and calls an elevator to meet her in the lobby.

Facial recognition through an intelligent video system and authentication through her smartphone (or other personal devices) allows Jane to enter the building unimpeded. Such system can be continuously monitoring Jane and collecting data regarding her emotional state, comfort level, and/or health state (e.g., detected passenger state).

At the elevator bank, an open elevator car is already waiting for her. She steps in and a voice says "Good morning Jane." The elevator system and controller recognizes Jane's preferences via her smartphone authentication (or other authentication or identification) and adjusts the temperature within the elevator car to a preset or predetermined temperature that can be based on Jane's profile. Further, additional features can be adjusted, such as playing a particular channel or newscast over speakers and/or on a display within the elevator car.

As described above, either directly or indirectly, the system can determine a detected passenger state of a passenger, such as Jane. For example, in this scenario, the system employs sensors that can read an increased heartbeat. Further, through the system and connection and/or communication with Jane's personal device, the system can automatically obtain calendar information to synchronize with her appointments stored on her personal devices or stored on the cloud. The elevator system can then take action to aid Jane and her mood. For example, the speakers can generate prerecorded audio or adapted or custom audio specific to Jane. For example, in one configuration the speakers can output "Don't worry Jane, your meeting has been postponed by 15 minutes. There's no rush." Jane can then check her smartphone or wearable device and see that she's received an updated calendar appointment with the delayed meeting. She relaxes for a moment.

As the elevator starts to move it alerts her that the room has also changed and it will now be taking her to the 52nd floor. The doors open on the 52nd floor. The elevator displays a floor map of the building and highlights the room where Jane will be presenting on the screen. Such display can be provided during Jane's travel within the elevator car, prior to arrival at the destination floor. The speakers can then output "Your meeting is in room 5210. Exit to the right and it's the third door on the left. Good luck with your presentation, Jane." Such customized and/or responsive and intelligent system can provide additional features to those described above.

After the presentation, the building system or elevator system connected thereto can recognize that Jane is walking to the elevator bank and can actively send an elevator car to the floor that Jane is currently on. Again, the elevator car can be prepared for Jane's presence, including but not limited to, adjustment of lighting, temperature, music, etc.

Further, in some configurations, the system can employ the displays within the elevator to provide messages to a passenger within the elevator car. For example, in this scenario, the display can be controlled by the elevator controller to display "Congratulations Jane on a job well done" and can present an offer to play celebratory music from predetermined music that can be based on her profile and/or based on Jane's detected passenger state. Due to the connectivity with Jane's personal devices, the elevator system can further provide information therefrom, such as "You also have a text from Jenny." Such notification can be displayed on a screen or provided in audio from the speakers of the elevator car.

The text from Jenny congratulates Jane on the presentation Jane gave and indicates that Jenny would like to grab drinks to celebrate. The elevator system can determine from the data of the text message the content thereof and asks Jane if she'd like to see recommendations for wine bars near the building.

Jane says yes (which can be detected by a microphone within the elevator car) or she can enter such response using an input device within the elevator car. The elevator system can then display a map of nearby locations on a display screen within the elevator car. Jane can then select one of the displayed options and asks the elevator system (either through audio or device input) to make a reservation and call a taxi or other car service. The elevator system can then indicate "There's traffic on the route." "But by taking a detour, it should only take five minutes to arrive. Your car will be waiting for you outside."

The elevator car doors open up to the lobby, and Jane can exit. The speakers within the elevator output "Have a nice day, Jane. Oh and, Jane . . . " She turns around outside the door. "Don't forget to pick up creamer on the way home."

As described in the above scenario and the described example embodiments, connected systems that can adjust elevator operating conditions and/or atmosphere are provided. Connectivity and passenger detection/monitoring can enable hyper-personalization which can cater to a passenger's detected passenger state or based on other characteristics. Various embodiments can be enabled through Bluetooth® based access control with various personal devices to verify and authenticate known users through smartphone or other connected personal devices. Using such connection, personal profiles can be obtained and/or loaded into the elevator system such that preferred actions can be taken by the elevator system. Near-Field Communication can detect and communicate between smart devices and the intelligent elevator system and/or building system. Further, geofencing can be employed to ensure data transfer and communication only within a secure boundary for identity protection.

Further, beyond passenger personalization, intelligent connectivity has huge benefits for building management and security. For example, connected cameras can use facial recognition and gait analysis to recognize individuals automatically and the emotional and/or physical/health state thereof (or can be used to detect a detected passenger state of an unknown or unidentified passenger). Further, for users with profiles, authentication technology can use facial recognition, fingerprint identification, voice recognition, etc. to identify such users and load or obtain specific predefined profiles specific to that user. Moreover, artificial intelligence systems can be used to perform analysis, manage historical data, etc. to determine visitor intent and enable a seamless passenger experience.

All of the above can enable a user interface and experience that turns the elevator systems of the present disclosure into an artificial intelligence concierge of sorts. The systems of the present disclosure can be able to interact with and enable a passenger to accomplish everyday tasks using technology such as intelligent building systems that use authenticated information and connectivity; destination dispatch technology for nearly hands-free passenger experience; interactive in-car LED screens to deliver custom content and information to riders; etc. Each of these features can be adjusted or otherwise controlled to cater to a passenger's detected passenger state as detected by the system (either directly or indirectly).

Advantageously, embodiments of the present disclosure provide elevator systems that can operate and/or be controlled based on a detected passenger state (e.g., emotional state, health state, and/or physical state).

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. An elevator system comprising:

an elevator car located within an elevator shaft;

at least one sensing device arranged within the elevator car;

an elevator controller arranged to control at least one of an operating condition and at least one feature within the elevator car; and a computing system in communication with the at least one sensing device and the elevator controller, wherein the computing system is arranged to detect a passenger state of a passenger within the elevator car and configured to control the operating conditions and features within the elevator car based on the detected passenger state, wherein the operating condition includes at least one of an elevator car dispatching, an elevator car acceleration, an elevator car deceleration, and an elevator car travel speed.

2. The elevator system of claim 1, wherein the at least one sensing and the computing system are arranged to detect the passenger state by at least one of direct detection and indirect detection.

3. The elevator system of claim 2, wherein direct detection includes at least one of video analytics, radar analytics, heartbeat detection, breathing detection, and detection of level of sweating of a detected passenger within the elevator car.

4. The elevator system of claim 1, wherein the at least one feature of the elevator car comprises lighting, temperature, music, spoken words, content displayed on a display screen within the elevator car, and content located on a passenger user device.

5. The elevator system of claim 1, wherein the detected passenger state is at least one of an emotional state, a comfort state, a health state, and a physical state of the detected passenger.

6. The elevator system of claim 1, wherein, when multiple passengers are present within the elevator car, the computing system is configured to determine at least one of an average detected passenger state and a highest priority detected passenger state.

7. The elevator system of claim 6, wherein the computing system control the operating conditions of the elevator car based on at least one of the determined average passenger state or the highest priority passenger state.

8. A method of controlling an elevator car comprising:

obtaining, at a computing system, detected passenger state data related to a passenger within an elevator car, the passenger state data obtained from one or more sensing devices; and adjusting at least one of an elevator car operating mode and feature within the elevator car based on the detected passenger state, wherein the operating condition includes at least one of an elevator car dispatching, an elevator car acceleration, an elevator car deceleration, and an elevator car travel speed.

9. The system method of claim 8, wherein the at least one sensing and the computing system are arranged to detect the passenger state by at least one of direct detection and indirect detection.

10. The method of claim 9, wherein direct detection includes at least one of video analytics, radar analytics, heartbeat detection, breathing detection, and detection of level of sweating of a detected passenger within the elevator car.

11. The method of claim 8, wherein the detected passenger state is at least one of an emotional state, a comfort state, a health state, and a physical state of the detected passenger.

12. The method of claim 8, wherein, when multiple passengers are present within the elevator car, the method further comprises:

determining at least one of an average detected passenger state and a highest priority detected passenger state; and operating and/or changing operating conditions based on at least one of the determined average or highest priority.

13. The method of claim 8, wherein the feature of the elevator car comprises at least one of lighting, temperature, music, spoken words, content displayed on a display screen within the elevator car, and content located on a passenger user device.

14. The method of claim 8, wherein the obtained passenger state data is stored and aggregated within the computing system and wherein the adjustment is based on only meta-data.

15. A method of controlling an elevator car comprising:

obtaining, at a computing system, detected passenger state data related to a passenger within an elevator car, the passenger state data obtained from one or more sensing devices; and adjusting at least one of an elevator car operating mode and feature within the elevator car based on the detected passenger state, in response to multiple passengers being present within the elevator car, the method further comprises:

determining an average detected passenger state and a highest priority detected passenger state, wherein the adjusting of the at least one of the elevator car operating mode and feature within the elevator car is based on the determined average passenger state and the highest priority passenger state.

16. The method of claim 15, wherein the detected passenger state is at least one of an emotional state, a comfort state, a health state, and a physical state of the detected passenger.

17. The method of claim 15, wherein the feature of the elevator car comprises at least one of lighting, temperature, music, spoken words, content displayed on a display screen within the elevator car, and content located on a passenger user device.

18. The method of claim 15, wherein the obtained passenger state data is stored and aggregated within the computing system and wherein the adjustment is based on only meta-data.

19. The method of claim 15, wherein the at least one sensing and the computing system are arranged to detect the passenger state by at least one of direct detection and indirect detection.

20. The method of claim 19, wherein direct detection includes at least one of video analytics, radar analytics, heartbeat detection, breathing detection, and detection of level of sweating of a detected passenger within the elevator car.

* * * * *